US007490361B1

(12) United States Patent
Floyd

(10) Patent No.: US 7,490,361 B1
(45) Date of Patent: Feb. 17, 2009

(54) WEIGHTED EXERCISE VEST

(76) Inventor: Noriko M. Floyd, 20945 NE. 37th Ct., Aventura, FL (US) 33180

( * ) Notice: Subject to any disclaimer, the term of this patent is extended or adjusted under 35 U.S.C. 154(b) by 32 days.

(21) Appl. No.: 11/639,486

(22) Filed: Dec. 15, 2006

Related U.S. Application Data

(60) Provisional application No. 60/797,306, filed on May 3, 2006.

(51) Int. Cl.
*A41D 13/00* (2006.01)

(52) U.S. Cl. ..... 2/94; 482/105

(58) Field of Classification Search ..... 2/102, 2/69, 115, 105, 83, 94, 2.5, 253; 482/105
See application file for complete search history.

(56) References Cited

U.S. PATENT DOCUMENTS 4,268,917 A 5/1981 Massey
4,407,497 A * 10/1983 Gracie ..... 482/105
4,658,442 A 4/1987 Tomlinson et al.
4,800,593 A * 1/1989 Ruffner ..... 2/108
5,002,270 A 3/1991 Shine
5,144,694 A 9/1992 Conrad Da oud et al.
5,398,340 A * 3/1995 Kibbee ..... 2/2.5
D409,697 S 5/1999 Ott
6,209,135 B1 4/2001 Irvin
6,397,392 B1 6/2002 Wooley et al.
2002/0040493 A1 4/2002 Wooley et al.

* cited by examiner

*Primary Examiner*—Tejash Patel
(74) *Attorney, Agent, or Firm*—Gold & Rizvi, P.A.; H. John Rizvi; Glenn E. Gold

(57) ABSTRACT

A weighted exercise vest includes a plurality of pockets for holding small items, and standard free gym weights. Each pocket includes a pocket opening and a pocket flap for securely retaining the items and weights within each corresponding pocket opening. The vest includes shoulder support pads for protecting the shoulders of a user by cushioning the weight of a weight-lifting equipment, such as a barbell, permitting a person to use the vest with alternative exercise regimens. The vest also includes shoulder panels and side panels including adjustable fastening means for adjusting the size of the vest to conform to different users.

18 Claims, 6 Drawing Sheets

WEIGHTED EXERCISE VEST

CROSS-REFERENCE TO RELATED APPLICATION

This application claims the benefit of U.S. Provisional Patent Application Ser. No. 60/797,306, filed May 3, 2006, which is incorporated herein in its entirety.

FIELD OF INVENTION

The present invention relates to exercise accessories, and more particularly, to an exercise vest including pockets for receiving weights, and shoulder pads for comfortably interacting with weight-lifting accessories.

BACKGROUND OF THE INVENTION

There has been a dramatic increase in health consciousness during recent years, as well as the desire to appear fit and trim. Health benefits associated with regular exercise are well known, and many methods of exercise have been developed to achieve this end. Common methods of exercising include home workout gyms, treadmills, bicycling, running, walking, and jogging. Though these methods have proven beneficial, the equipment is costly and nonmobile, and the person exercising often wishes to utilize weights to supplement running or jogging in order to firm and tone particular muscles. To meet this goal, user's often resort to barbells, or other forms of hand-held weights.

In an effort to make the exercise regimen more efficient, allowing for a more hands-free experience, there have emerged a variety of exercise garments. One such garment is the weighted vest. The conventional weighted vest generally includes a front and back panel that are adjustably attached together to form a body vest that is worn on the upper torso of a person. The weighted vest further includes a number of chambers that are configured to retain weights. The chambers are equally situated about the vest so as to distribute the retained weight evenly about the user. The use of these conventional vests have been found to quickly tone and firm muscles, and provide aerobic benefits as well.

The existing weighted vests, however, are not without certain drawbacks. Many weighted vests include compartments dimensioned to permanently retain weights. The permanently fixed weights do not allow a user to shift the weight from one compartment to another so as to target specific muscles of the body, if desired. Other weighted vests provide pockets that are used for particular items, such as camping or hiking equipment, which are extraneous to the issue of weight training. Other drawbacks include weighted vests that do not accommodate the use of standard gym free weights. Many weighted vests require the use of preformed weights that are specifically tailored to correspond to the dimension and capacity of each vest compartment, thus requiring a user to separately transport special weights.

Additional shortcomings of some conventional vests is that many vest include a number of buckles, straps, or laces that must be adjustably attached together to secure the vest on the upper torso of the user's body. The buckles, straps or laces are frustrating, and time consuming to attach, and often come loose when an athlete is moving resulting in the vest shifting and the weights swinging about the user. The buckles, straps and laces also come loose and rub, bruise or chaf about the torso or hip area of the wearer. Additionally, conventional designs of current vests do not include comfortable features that permit a user wearing the vest to interact with other exercise equipment, such as weight-lifting devices.

Accordingly, there is a need for a weighted vest that, in addition to increasing the benefits of weight and aerobic training, eliminates the necessity of users transporting their own weights to the gym, by allowing the use of standard gym free weights that are removeably retained within receiving pockets. There is also a need for a weighted vest that provides protection and comfort to a user when using weight-lifting equipment, is compact, easy to carry and store, is securely and easily adjustable, and inexpensive to manufacture.

SUMMARY OF THE INVENTION

The present invention overcomes the deficiencies of the known art and the problems that remain unsolved by providing a weighted exercise vest that is comfortable to wear, adjustable, and includes a plurality of pockets for retaining small items and standard free gym weights. Moreover, the overall construction of the weighted exercise vest provides shoulder support pads for using the vest with other exercise regimens, such as weight-lifting.

In accordance with one embodiment of the present invention, there is provided a weighted exercise vest comprising a front member including a right panel, a left panel, and a front fastening means connected to the right and left panels for fastening the vest about a user. The vest further includes a first pocket, and a second pocket for retaining a weight, where the pockets are disposed on both the right panel, and the left panel. Each pocket has a pocket opening, and a pocket flap for closing the pocket opening. Front shoulder panels, and front side panels, include a front panel fastening means, and each front shoulder panel, and each front side panel is integrally formed with the right panel and the left panel. A back member includes a back panel having back shoulder panels, and back side panels, each back shoulder panel, and each back side panel is correspondingly aligned with each front shoulder panel, and each front side panel, and includes a back panel fastening means.

The vest also includes a first support pad, and a second support pad where each support pad is disposed on the back panel adjacent a corresponding back shoulder panel. A back weight pocket is disposed on an exterior surface of the back member, and the back weight pocket has a weight pocket opening for receiving another weight, and a weight pocket flap for securing the weight within the weight pocket opening. The front member, and the back member are joined together so that the front panel fastening means adjustably engages with the back panel fastening means such that the members, and the panels combine to form the vest having a left arm opening, a right arm opening, and a neck opening.

Additionally, each pocket includes a pocket fastening means, and each flap includes a flap fastening means. Each flap is folded over each corresponding pocket opening so that the pocket fastening means engages with the flap fastening means for securely closing the corresponding pocket opening. The first pocket is sized to retain one or more items comprising any one of jewelry, keys, money, wallet, cell phone, water bottle, food, or any other small item or product that a user wishes to store therein.

Advantageously, the weights comprise standard gym free weights that are dimensioned to fit securely within either or both of the second pocket openings, and the back weight pocket opening. The weights may or may not comprise the same mass.

Alternatively, the weight pocket flap includes a plurality of straps. Each strap includes a strap fastening means for detachably engaging with a corresponding weight pocket fastening means for securely holding a weight within the weight pocket opening. The plurality of straps are situated about the weight to better retain the weight within the weight pocket opening.

Preferably, the fastening means includes any one of snaps, hook and loop, zippers, buttons, magnets, rope, buckles, ties, quick releases, release tape, clips, clamps, eyelet catch, or any combination thereof. Advantageously, each support pad is aligned on the back panel to protect the shoulders of a person, and to cushion the weight of a weight-lifting device, such as a barbell when the person also engages in weight-lifting while also wearing the vest.

In accordance with an alternative embodiment of the present invention, there is provided a weighted exercise vest comprising a right member having a right shoulder panel, and a right side panel, and a left member having a left shoulder panel, and a left side panel. The right member and the left member includes a front fastening means for fastening the vest. A first pocket, and a second pocket is disposed on both the right member and the left member in vertical orientation with each other. Each pocket has a pocket opening, and a pocket flap for sealing the pocket opening.

The vest further includes a back member having a right back shoulder panel, a left back shoulder panel, a right back side panel, and a left back side panel. The shoulder panels, and the side panels correspondingly align with each other. A first support pad, and a second support pad is disposed on the back member adjacent each corresponding back shoulder panel. A back weight pocket is disposed on the back member. The back weight pocket comprises a weight pocket opening, and a weight pocket flap. The members are joined together so that each panel adjustably attaches together to form the exercise vest having a left arm opening, a right arm opening, and a neck opening.

In yet another embodiment, there is provided a weighted vest for exercising, where the weighted vest comprises a front body having shoulder panels and side panels, and a back body having back shoulder panels, and back side panels. The panels correspondingly align with each other. A plurality of pockets are disposed on the front body, and each pocket includes a pocket opening, and a pocket flap for sealing the pocket opening. The plurality of pockets includes a first item pocket and a second item pocket for holding items, and a third pocket opening, and a fourth pocket opening for holding a weight.

The vest additionally includes a first support pad, and a second support pad where each support pad is disposed on the back body adjacent a corresponding back shoulder panel. A weight pocket including a weight pocket opening, and a weight pocket flap, is formed on the exterior surface of the back body. The weight pocket opening, third pocket opening, and fourth pocket opening is sized to retain a weight comprising a standard gym free weight that is dimensioned to fit securely therein. The front body is joined to the back body so that the panels detachably connect together to form the vest.

Regarding the embodiments described herein, as well as those covered by the claims, weights are loaded within the weight pocket opening, and second pocket opening, or third and fourth pocket openings and the pocket flaps are folded over the pocket openings for securely retaining the weights therein. A person assembles the vest by attaching the panels together via, the fastening means, and securely attaches the vest about the body. Each pocket may or may not be transparent for allowing a person to view the contents of each pocket. The vest may be fabricated from a material having sufficient durability, strength and flexibility, where the material may comprise one or more layers. Non-limiting examples of such materials includes any one of nylon, plastic, rubber, leather, fabric, a synthetic or non-synthetic material, foam, vinyl, a mesh material, an elastic material, or any combination thereof.

DETAILED DESCRIPTION OF THE PREFERRED EMBODIMENTS

One or more embodiments of the present invention are disclosed herein. It will be understood that the disclosed embodiments are merely exemplary of the invention that may be embodied in various and alternative forms. The appended figures may be exaggerated or minimized to show details of particular embodiments, features, or elements. Specific structural and functional details, dimensions, shapes, or configurations disclosed herein are not limiting but serve as a basis for teaching a person of ordinary skill in the art the described and claimed features of embodiments of the present invention.

It will be understood that the term "weight" or "weights" as used herein includes any material having any configuration defined by the vertical force exerted by a mass as a result of gravity and/or sports equipment used in calisthenic exercises and weightlifting that is not attached to anything and is raised and lowered by the use of the hands, legs and arms. Some non-limiting examples of weights include, water, cement, lead, metal, rock, dirt, brass, hard rubber, steel, any liquid, any solid, or any gas.

Figure 1:
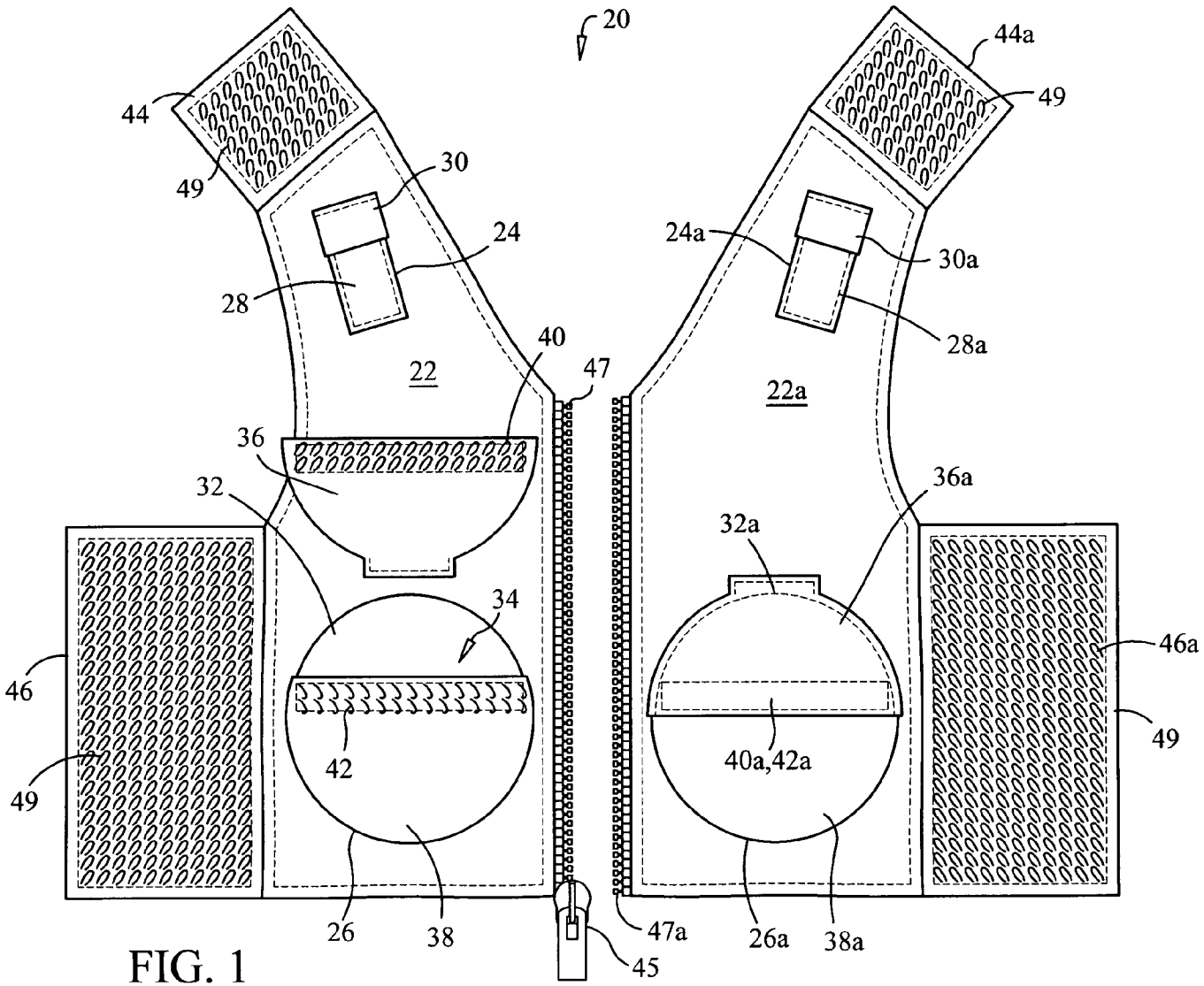
FIG. 1 is a plan exterior view of a front member of a weighted exercise vest, showing a weight placed within a pocket, in accordance with the present invention.

Referring now to the drawings wherein like elements are represented by like numerals throughout, there is shown in FIG. 1, a plan exterior view of a front member 20 of a weighted exercise vest 10. The front member 20 includes two symmetrical panels comprising a right panel 22 and a left panel 22*a*. The terms, "left" and "right" as used herein refers to the side of a wearer's body that is covered by each corresponding panel 22, 22*a*. Each panel 22, 22*a* includes a first pocket 24, 24*a* and a second pocket 26, 26*a* that are aligned in vertical orientation with one another. Each first pocket 22, 22*a* comprises a pocket opening 28, 28*a* for receiving one or more items, and a pocket flap 30, 30*a*. Each pocket flap 30, 30*a* is stitched along the top of each corresponding pocket opening 28, 28*a*, respectively. Each pocket flap 30, 30*a* includes a flap fastening means that engages with a pocket fastening means disposed on the exterior surface of each pocket 22, 22*a*.

The fastening means engage together to securely retain an item within either or both pocket openings 28 and 28*a*. The fastening means as described herein throughout, may comprise any one of releasable adhesive, a zipper, one or more buttons, hook and loop generally known as Velcro, magnets, snaps, quick releases, or drawstrings to temporarily close the pocket openings 28, 28*a* so as to better retain the items internally within the pocket openings 28 and 28*a*.

The term item may include any small item or product that a user wishes to keep secure within either or both of the first pockets 28, 28*a* of the vest 10. Some examples of items that may be retained within each first pocket opening 28, 28*a* include money, jewelry, keys, pen, or a comb. In a preferred example, one or both of the pocket openings 28, 28*a* may be sized and shaped to securely retain a cell phone.

Each second pocket 26, 26*a* comprises a weight pocket opening 34, 34*a*, and a weight pocket flap 36 and 36*a*. Each weight pocket flap 36, 36*a* is stitched to pivot along the top of a corresponding weight pocket opening 34 and 34*a*. Each weight pocket opening 36, 36*a* is defined by a front member 38, 38*a* that is stitched to each panel 22, 22*a*, respectively, along a semi-circle pattern to provide a semi-shaped pocket opening 34, 34*a* for securely receiving and holding a correspondingly shaped weight 32 and 32*a*. The weight pocket flaps 36, 36*a* also comprise a semi-shaped flap that is dimensioned to cover the semi-shaped pocket opening 34, 34*a* of each second pocket 26 and 26*a*. It will be noted that the shape of the pockets 26, 26*a* and flaps 36, 36*a* are exemplary only, and that other shapes and sizes may be implemented without departing from the scope of the invention.

A flap fastening means 40, and a pocket fastening means 42 is attached to the weight pocket flap 36, and front member 38 of pocket 26, respectively. Similar fastening means are also used on weight pocket flap 36*a*, and front member 38*a*. The fastening means 40 and 42 engage with one another to securely retain a selected weight 32, 32*a* within either or both weight pocket openings 34. The shape and size of each pocket 26, 26*a*, and pocket opening 34, 34*a* is dimensioned to receive a standard gym free weight 32, 32*a* that typically comprises a rounded lead shot weight. A weight 32, 32*a* is disposed within either or both weight pocket openings 34, 34*a*, and the corresponding pocket flap 36, 36*a* is pivotably closed to engage the fastening means 40 and 42.

Figure 2:
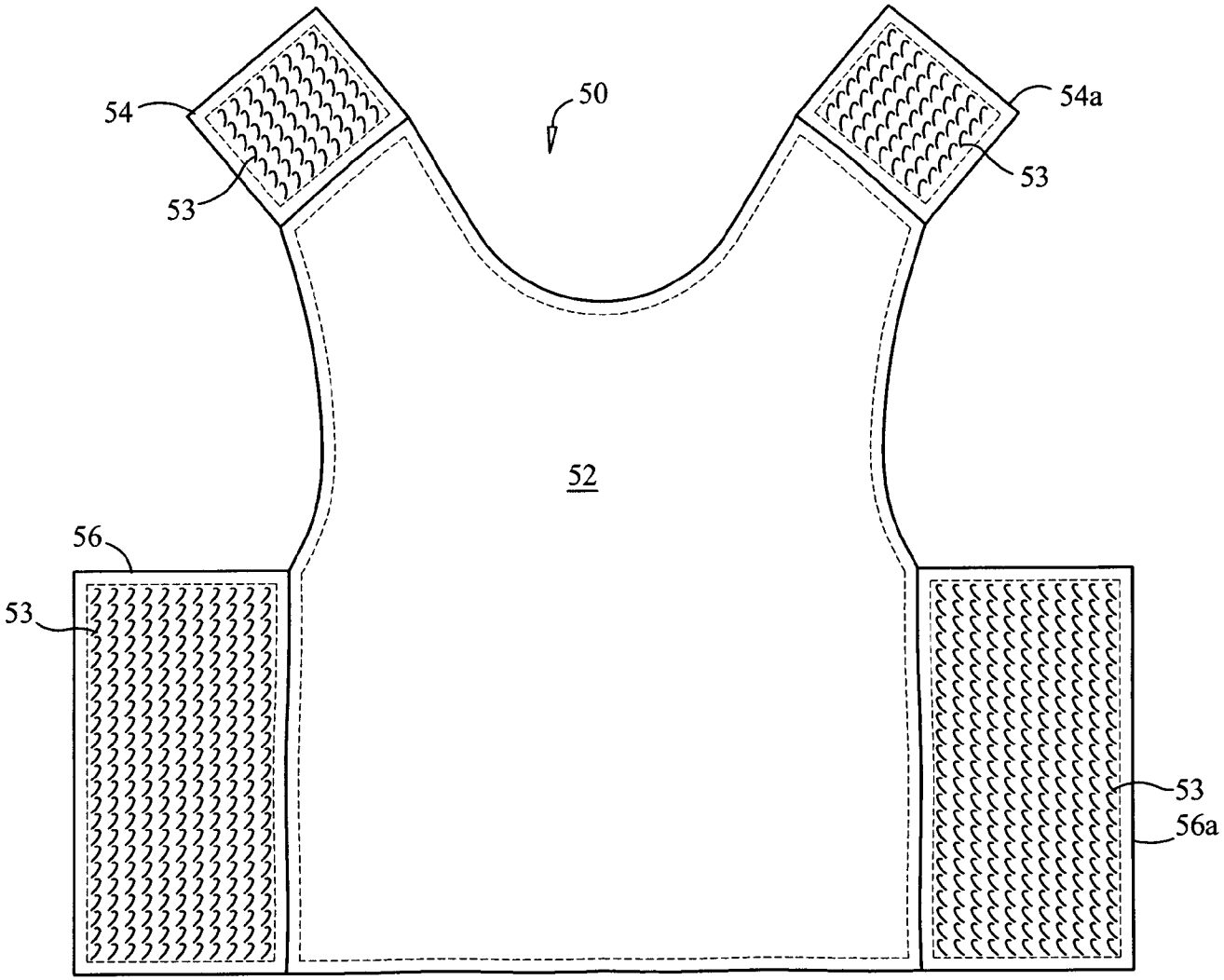
FIG. 2 is a plan interior view of a back member of the weighted exercise vest.

With continued reference to FIG. 1, both the right panel 22 and the left panel 22*a* each further include a front shoulder panel 44, 44*a*, and a front side panel 46 and 46*a*. Each front shoulder panel 44, 44*a* extends from a shoulder portion of each panel 22, 22*a* and each front side panel 46, 46*a* extends from the side portion of each panel 22, 22*a*. Together, the panels 22, 22*a*, 44, 44*a*, 46 and 46*a* define a front neck area, a left arm area, and a right arm area for accommodating the neck and arms of a wearer. Each front shoulder panel 44, 44*a*, and each front side panel 46, 46*a* comprises a length and height that is selected to adjustably engage with a corresponding back shoulder panel 52, 52*a* and a back side panel 54, 54*a* of a back member 50, as illustrated in FIG. 2. Each front shoulder panel 44, 44*a*, and each front side panel 46, 46*a* includes a panel fastening means 49 for attaching each front panel 44, 44*a*, and each front side panel 46, 46*a* to a corresponding back panel 52, 52*a*, and back side panel 54, 54*a*, respectively.

The panel fastening means 49 comprises any one of releasable adhesive, a zipper, one or more buttons, hook and loop generally known as Velcro, magnets, snaps, quick releases, or any combination thereof.

In one exemplary embodiment, the right panel 22, and left panel 22*a*, of front member 20, includes a zipper segment 47, 47*a*. Each zipper segment 47, 47*a* extends upwards from a lateral edge of each panel 22, 22*a* a predetermined distance. Zipper segment 47 includes a zipper handle 45 that is used to securely attached the two zipper segments 47, 47*a* together to join the right panel 22, and left panel 22*a* together. It will be understood that although the preferred embodiment discloses a zipper, other attachable means known to one of ordinary skill in the art may be used.

Referring now to FIG. 2, there is shown a plan interior view of a back member 50 of the weighted exercise vest 10. The back member 50 is sized and shaped to correspond to the size and shape of front member 20. The back member 50 comprises a back panel 52 having back shoulder panels 54 and 54*a*. Each shoulder panel 54, 54*a* extends from a shoulder portion of the back panel 52.

The back panel 52 further includes back side panels 56 and 56*a* that are each attached along the outer side edges of the back panel 52. Preferably, each back shoulder panel 54, 54*a*, and each back side panel 56, 56*a* corresponds to the shape and size of each front should panel 44, 44*a*, and each front side panel 46 and 46*a*, respectively. Together, the panels 52, 54, 54*a*, 56, and 56*a* define a back neck area, a back left arm area, and a back right arm area for accommodating the neck and arms of a wearer, as better illustrated in FIG. 5. Each back shoulder panel 54, 54*a*, and each back side panel 56 and 56*a* includes a panel fastening means 53 for adjustably attaching the back shoulder panels 54, 54*a*, and the back side panels 56, 56*a* to the front shoulder panels 44, 44*a*, and the front side panels 46 and 46*a*, respectively.

Figure 3:
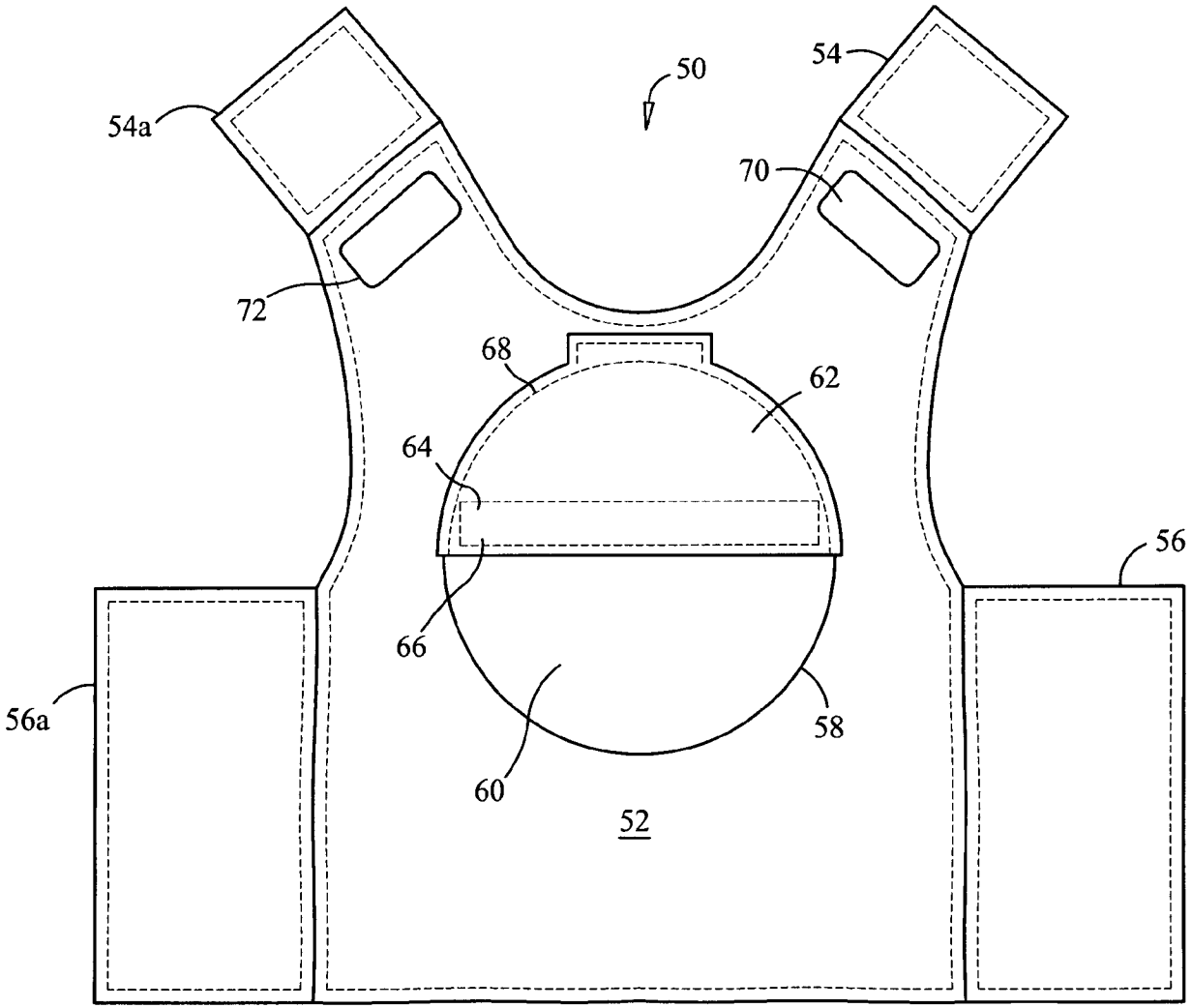
FIG. 3 is a plan exterior view of the back member of the weighted exercise vest.

Turning now to FIG. 3, there is a plan exterior view of the back member 50 of the weighted exercise vest 10. The back member 50 comprises a back panel 52 including a back weight pocket 58 having a back pocket opening 60, and a back pocket flap 62. The back pocket flap 62 comprises a semi-circle shaped flap that is stitched on top of the pocket opening 60, near the edge of the back neck area. The back pocket flap 62 includes a flap fastening means 64 that engages with a pocket fastening means 66 disposed on exterior surface of the back weight pocket 58. The back pocket opening 60 is sized and shaped to retain a standard gym free weight 68. It should be emphasized that the weights 32, 32*a* and 68 may comprise the same or different weights having the same or different masses.

Preferably, the back pocket opening 60 comprises a semi-circle shape that corresponds to the circular shape of a gym free weight 68 providing for a more contoured fit. In one exemplary embodiment, the back weight pocket 58 is positioned on the top center of back panel 52 so as to distribute the carried weight 68 evenly about the backside of a wearer.

It will be noted that the back member 50 may include one or more back weight pockets 58 that are disposed anywhere on the exterior surface of the back panel 52 for holding one or more weights 68. Further one or more back weight pockets 58 may also be provided on either or both exterior surface of each back side panel 56 and 56*a*.

The back member 50 further includes shoulder support pads 70 and 72 for allowing a wearer to comfortably engage in other exercises such as weight-lifting. Each shoulder support pad 70 and 72 is positioned about a corresponding shoulder portion of back panel 52, and comprises a padded material that is enclosed within a protective sheath. The padded material may comprise a thick rubber, foam, cotton, or the like. The protective sheath material is a durable material that is able to withstand the wear and tear of repeatingly engaging the pads 70, 72 with a weight-lifting apparatus, such as a barbell 74, as better illustrated in FIG. 6.

Figure 4:
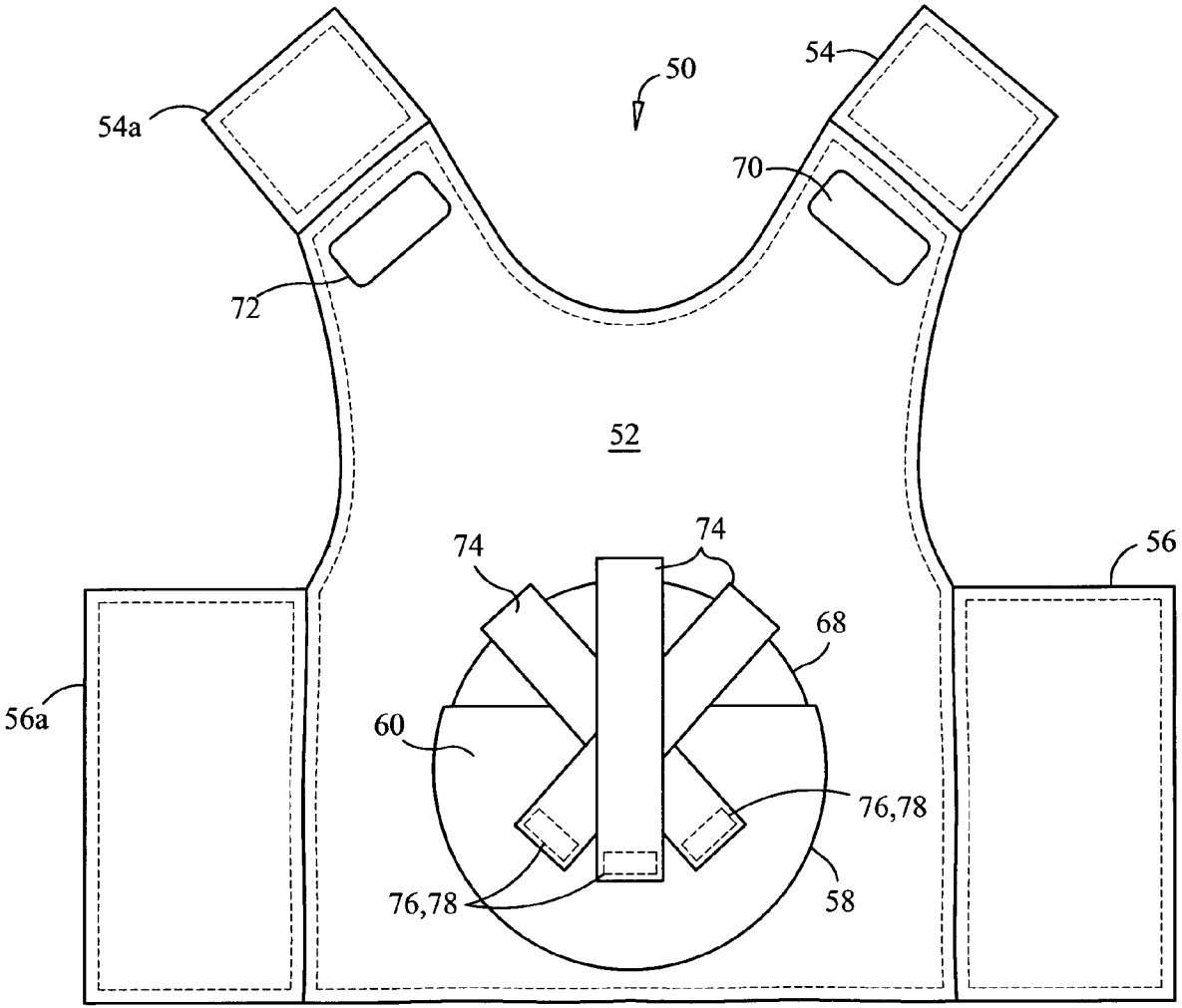
FIG. 4 is a plan exterior view of a back member of a weighted exercise vest, in accordance with an alternative embodiment of the present invention.

FIG. 4 shows a plan exterior view of a back member 50 of a weighted exercise vest 10, in accordance with an alternative embodiment of the present invention. The features, elements, and configuration of the back member 50 are the same as illustrated in FIGS. 2 and 3, except that the embodiment of FIG. 4 includes a plurality of back pocket straps 74 rather than a single back pocket flap 62. One end of each back pocket strap 74 is attached at various points along the top perimeter of the back pocket opening 60 to evenly secure a weight 68 retained within the back pocket opening 60. Another end of each back pocket strap 74 includes a strap fastening means 76 for engaging with a pocket fastening means 78 that is disposed on the outer surface of the back pocket 58. Each back pocket strap 74 may comprise the same or different widths, shapes or lengths.

The weighted exercise vest 10 may be fabricated from a suitable material having sufficient strength and flexibility such as nylon, plastic, rubber, fabric, a synthetic or non-synthetic material, foam, vinyls, a mesh material for increasing the ventilation of the vest 10, an elastic material, or any combination thereof. The materials selected may comprise one or more layers. In addition, each pocket 24, 24*a*, 26, 26*a*, 58 may or may not be transparent to allow a person 100 to see the type of weight 32, 32*a*, 68 and/or item that is retained therein, and may be formed on any surface of the vest 10. Each pocket 24, 24*a*, 26, 26*a*, 58 may comprise a variety of shapes, sizes or dimensions for defining a desired volume for holding one or more weights 32,32*a*, 68 and/or items.

Figure 5:
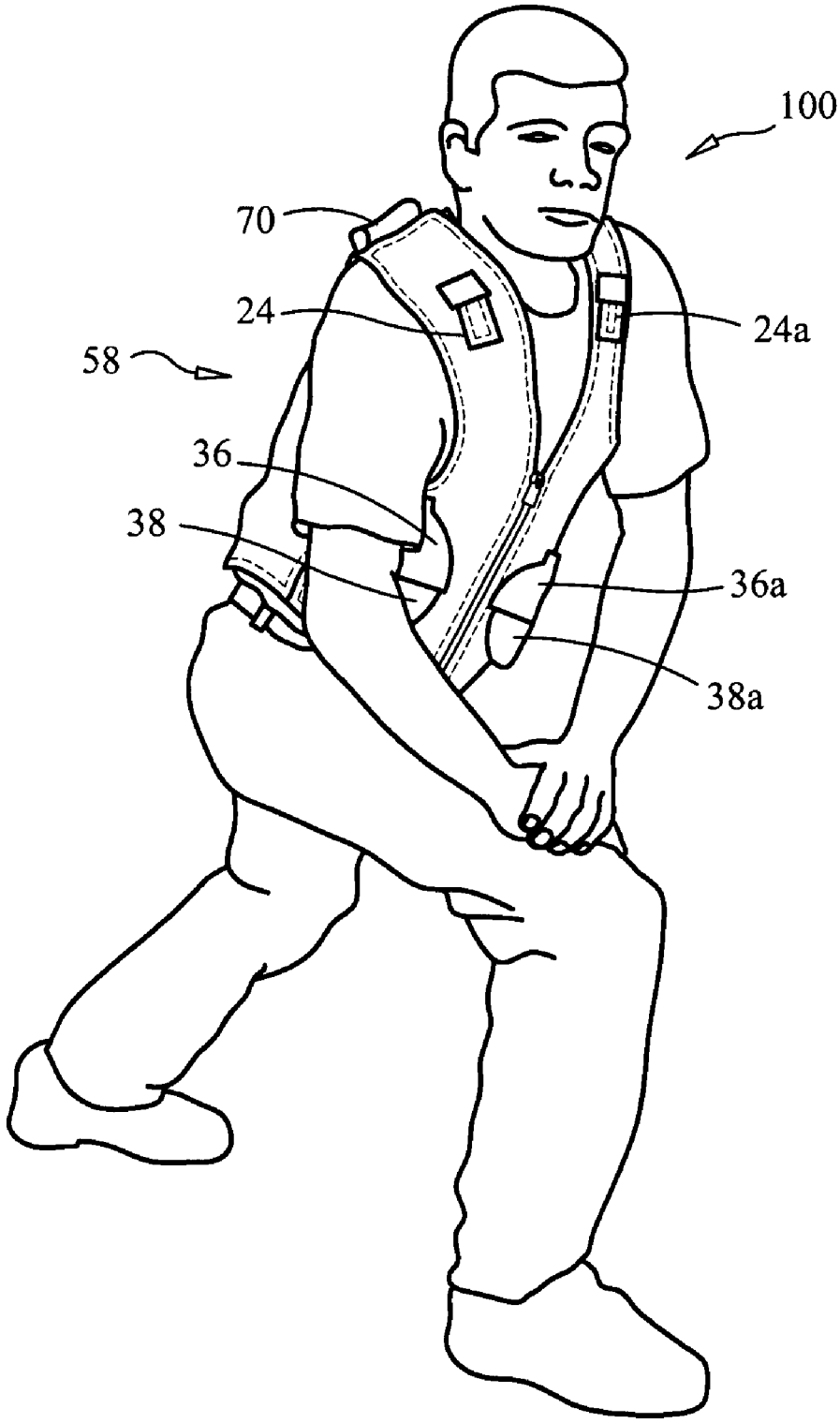
FIG. 5 is a front perspective view of a weighted exercise vest worn on a person, according to the present invention.

Referring now to FIG. 5, there is shown a front perspective view of a weighted exercise vest 10 worn on a person 100, according to the present invention. The panels 22, 22*a*, 44, 44*a*, 46, 46*a*, 54, 54*a*, 56 and 56*a* are releasably attached together such that the combination of the front member 20 and back member 50 define a pair of arm openings, a neck opening, and a waist opening for receiving the arms, neck and waist of a user 100. Weights 32, 32*a* and 68 are subsequently inserted within the front weight pockets 26 and 26*a*, and the back weight pocket 58. The flaps 36, 36*a*, 62, or straps 74 are attachably folded to seal each pocket opening 34, 34*a* and 60, respectively, to further secure the weights 32, 32*a* and 68 therein. A person 100 puts the weighted exercise vest 10 on placing each arm through the arm openings. The right panel 22 and left panel 22*a* are attached together, around the waist, via, the zipper, and the shoulder support pads 70 and 72 are positioned near the top of the person's shoulders.

The fastening means 49 and 53 allows the exercise vest 10 to conform to the torso size of many different users 100, adults and children alike, provides adjustable degrees of tightness on a user, and allows for easy and quick attachment and detachment. Once the exercise vest 10 is loaded with the desired weights 32, 32*a*, 68, and fitted onto a user 100, the user 100 is free to perform a variety of exercises to strengthen and tone the muscles.

Figure 6:
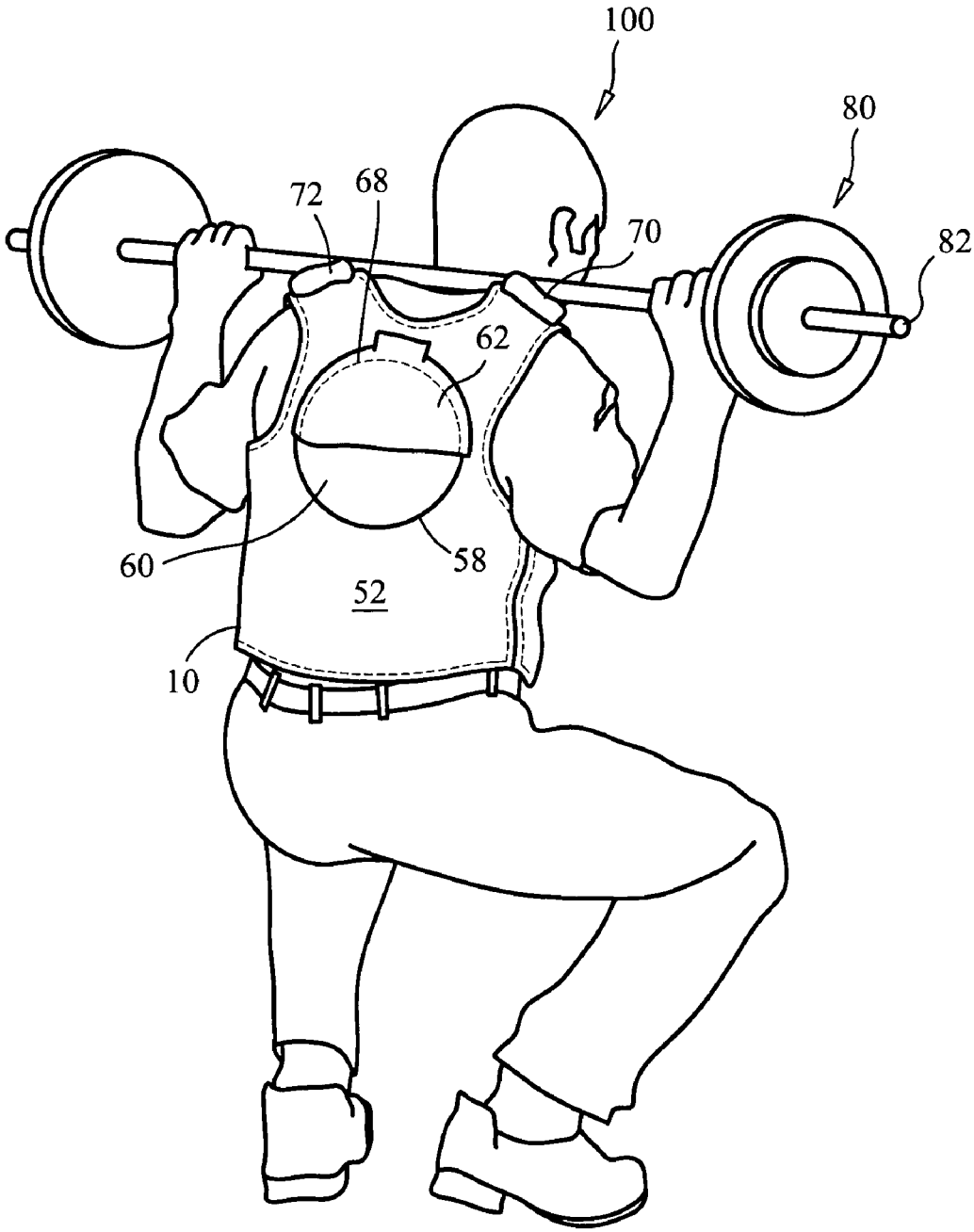
FIG. 6 is a rear perspective view of the person wearing the weighted exercise vest having shoulder supports for providing added comfort when exercising with barbells.

As seen in FIG. 6, the weighted exercise vest 10 can also be used in conjunction with other weight training regimens. For example, a user 100 can wear the exercise vest 10, and also engage in weight-lifting. The added weight of the barbell 80 assembly provides for a more intense workout. As shown, a shaft 82 of barbell 80 is allowed to rest on each shoulder support pad 70 and 72 thereby providing a more comfortable way of exercising with weight-lifting equipment 80. The shoulder support pads 70 and 72 prevent the shaft 82 of barbell 80 from scrapping, chafing, or rubbing on the shoulders of the person 100.

The weighted exercise vest 10 of the present invention provides a hands-free means of exercising, is easy to assemble, comfortable to wear, accommodates the use of standard gym free weights, and can be used with a variety of weight training regimens.

It should be emphasized that the above-described embodiments are merely exemplary illustrations of implementations set forth for a clear understanding of the principles of the invention. Many variations, combinations and modifications may be made to the above-described embodiments without departing from the scope of the invention as defined and intended by the following claims.

What is claimed is:

1. A weighted exercise vest comprising:

a front member including a right panel, a left panel, and a front fastening means connected to said right and left panels for fastening said vest about a user;

first pockets, and second pockets for retaining a weight, each pocket including a pocket opening and a pocket flap for closing said pocket opening;

front shoulder panels, and front side panels, said front shoulder panels, and said front side panels including a front panel fastening means, each front shoulder panel, and each front side panel integrally formed with said right panel and said left panel, a first of said first pockets disposed on a first shoulder panel, and a second of said first pockets disposed on a second shoulder panel; a back member including a back panel having back shoulder panels, and back side panels, each back shoulder panel, and each back side panel correspondingly aligned with each front shoulder panel, and each front side panel, and including a back panel fastening means;

a first support pad, and a second support pad, each support pad being disposed on said back panel adjacent a corresponding back shoulder panel;

a back pocket having a back pocket opening and a back pocket flap, said back pocket disposed on an exterior surface of said back member; and wherein said front member, and said back member are joined together so that said front panel fastening means adjustably engages with said back panel fastening means such that said member, and said panels combine to form said vest having a left arm opening, a right arm opening, and a neck opening, and wherein said second pockets, and said back pocket comprises a semi-circular shape to correspondingly hold a standard gym weight therein.

2. The exercise vest of claim 1, wherein each pocket includes a pocket fastening means, and each flap includes a flap fastening means, each flap being folded over each corresponding pocket opening where said pocket fastening means engages with said flap fastening means for securely closing said corresponding pocket opening.

3. The exercise vest of claim 2, wherein each of said first pockets is sized to retain one or more items comprising any one of jewelry, keys, money, wallet, cell phone, water bottle, food, or any other small item or product that a user wishes to store in any one of said first pockets.

4. The exercise vest of claim 3, wherein said back pocket flap includes a plurality of straps, each strap including a strap fastening means for detachably engaging with a corresponding back pocket fastening means for securely holding a standard gym weight within said back pocket opening.

5. The exercise vest of claim 4, wherein said fastening means includes any one of snaps, hook and loop, zippers, buttons, magnets, rope, buckles, ties, quick releases, release tape, clips, clamps, eyelet catch, or any combination thereof.

6. The exercise vest of claim 1, wherein each support pad is aligned on said back panel to cushion the weight of a weight-lifting device when each support pad engages with said weight-lifting device, such as a barbell.

7. The exercise vest of claim 1, wherein said members, said panels, said pockets, said flaps, and said straps are fabricated from a material having sufficient durability, strength and flexibility, said material comprising any one of nylon, plastic, rubber, leather, fabric, a synthetic or non-synthetic material, foam, vinyl, a mesh material, an elastic material, or any combination thereof.

8. A weighted exercise vest comprising:

a right member having a right shoulder panel, and a right side panel:

a left member having a left shoulder panel, and a left side panel, said right member and said left member including a front fastening means for fastening said vest about a user;

first pockets, and second pockets, each first pocket and each second pocket including a pocket opening and a pocket flap, each of said first pockets in vertical orientation with each second pocket, a back member having a right back shoulder panel, a left back shoulder panel, a right back side panel, and a left back side panel, said shoulder panels, and said side panels correspondingly aligned with each other;

a first support pad, and a second support pad, each support pad being disposed on said back member adjacent each corresponding back shoulder panel;

a third pocket having a third pocket opening and a third pocket flap, said third pocket disposed on said back member; and wherein said members are joined together so that each panel adjustably attaches together to form said vest having a left arm opening, a right arm opening, and a neck opening, and wherein each of said second pockets and said third pocket comprises a semi-circular shape for correspondingly storing a standard gym weight therein.

9. The exercise vest of claim 8, wherein each panel includes a panel fastening means, each pocket includes a pocket fastening means, and each flap includes a flap fastening means, each flap being folded over each corresponding pocket opening where said pocket fastening means engages with said flap fastening means for securely closing said corresponding pocket opening.

10. The exercise vest of claim 9, wherein each of said first pocket opening is sized to retain one or more items comprising any one of jewelry, keys, money, wallet, cell phone, water bottle, food, or any other small item or product that a user wishes to store in said first pocket openings.

11. The exercise vest of claim 10, wherein said third pocket flap includes a plurality of straps, each strap including a strap fastening means for detachably engaging with said pocket fastening means for securely holding a standard gym weight within said third pocket opening.

12. The exercise vest of claim 11, wherein said fastening means includes any one of snaps, hook and loop, zippers, buttons, magnets, rope, buckles, ties, quick releases, release tape, clips, clamps, eyelet catch, or any combination thereof.

13. The exercise vest of claim 8, wherein each support pad is aligned on said back panel to cushion the weight of a weight-lifting device when each support pad engages with said weight-lifting device, such as a barbell.

14. The exercise vest of claim 11, wherein said members, said panels, said pockets, said flaps, and said straps are fabricated from a material having sufficient durability, strength and flexibility, said material comprising any one of nylon, plastic, rubber, leather, fabric, a synthetic or non-synthetic material, foam, vinyl, a mesh material, an elastic material, or any combination thereof.

15. A weighted vest for exercising, said weighted vest comprising:

a front body having shoulder panels and side panels;

a back body having back shoulder panels, and back side panels, said panels correspondingly aligning with each other;

a plurality of pockets disposed on said front body, each pocket having a pocket opening, and a pocket flap for sealing said pocket opening;

a first support pad, and a second support pad, each support pad disposed on said back body adjacent a corresponding back shoulder panel;

a weight pocket including a weight pocket opening, and a weight pocket flap, said weight pocket formed on the exterior surface of said back body; and wherein said front body is joined to said back body so that said panels detachably connect together to form said vest, and wherein each of said pocket opening comprises a semi-circular shape dimension for releasably holding a standard gym weight.

16. The weighted vest of claim 15, wherein each panel includes a panel fastening means, each pocket includes a pocket fastening means, and each flap includes a flap fastening means, each flap being folded over each corresponding pocket opening so that said pocket fastening means engages with said flap fastening means for securely closing said pocket opening.

17. The exercise vest of claim 16, wherein said plurality of pockets includes a first pocket and a second pocket for holding items, and a third pocket and fourth pocket for holding a standard gym weight, and wherein said weight pocket opening is sized to retain another standard gym weight, said standard gym weights fitting securely within each corresponding pocket opening.

18. The exercise vest of claim 17, wherein said vest is fabricated from a material having sufficient durability, strength and flexibility, said material comprising any one of nylon, plastic, rubber, leather, fabric, a synthetic or non-synthetic material, foam, vinyl, a mesh material, an elastic material, or any combination thereof.

* * * * *